US012378830B2

(12) United States Patent
Al-Ghamdi

(10) Patent No.: US 12,378,830 B2
(45) Date of Patent: Aug. 5, 2025

(54) MUDLINE SUSPENSION SYSTEM RUNNING TOOL WITH TILTED CIRCULATION PORTS

(71) Applicant: SAUDI ARABIAN OIL COMPANY, Dhahran (SA)

(72) Inventor: Bakr Abdulrahim Al-Ghamdi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/329,488

(22) Filed: Jun. 5, 2023

(65) Prior Publication Data

US 2024/0401423 A1 Dec. 5, 2024

(51) Int. Cl.
*E21B 23/00* (2006.01)

(52) U.S. Cl.
CPC ..... *E21B 23/00* (2013.01)

(58) Field of Classification Search
CPC ..... E21B 23/10; E21B 43/10; E21B 43/101; E21B 23/00; E21B 33/035; E21B 33/043; E21B 33/04; E21B 41/0078
See application file for complete search history.

(56) References Cited

U.S. PATENT DOCUMENTS 3,593,786 A * 7/1971 Lewis ..... E21B 41/0078 251/343
4,739,845 A * 4/1988 Dennis ..... E21B 10/61 175/393
5,655,603 A * 8/1997 Schulte ..... E21B 33/043 166/368
2010/0288492 A1* 11/2010 Blackman ..... E21B 27/005 166/250.01
2015/0260001 A1* 9/2015 Kuo ..... E21B 33/1212 277/626

* cited by examiner

*Primary Examiner* — Tara Schimpf
*Assistant Examiner* — Ursula Lee Norris
(74) *Attorney, Agent, or Firm* — Vorys, Sater, Seymour and Pease LLP

(57) ABSTRACT

A running tool for installing casing in a wellbore includes a tubular body defining an interior wall, an exterior wall and a longitudinal axis extending therethrough. An upper connector is defined at an upper end of the tubular body for coupling with an upper portion of a casing string and a lower connector is defined at a lower end of the tubular body to releasably couple the tubular body to a casing hanger in an axially approximated position and an axially displaced position with respect to the casing hanger. A plurality of circulation ports are circumferentially spaced around the tubular body. A portion of at least one circulation port extends along a trajectory obliquely arranged with respect to a radial direction defined by the tubular body to direct fluid expelled through the at least one circulation port along the exterior wall of the tubular body.

18 Claims, 5 Drawing Sheets

MUDLINE SUSPENSION SYSTEM RUNNING TOOL WITH TILTED CIRCULATION PORTS

FIELD OF THE DISCLOSURE

The present disclosure relates to a mudline suspension system for supporting a casing string within a wellbore, and more specifically, the disclosure relates to a running tool for delivering the casing to a hanger and for cleaning an annulus defined around the casing.

BACKGROUND OF THE DISCLOSURE

Hydrocarbon resources are often located below the earth's surface, sometimes tens of thousands of feet below the surface. Sometimes hydrocarbon fluids, e.g., oil and/or gas, reside in terrestrial locations and sometimes in geologic formations that lie beneath a body of water. In order to extract the hydrocarbon fluid, wellbores may be drilled through the geologic formations to access subterranean hydrocarbon reservoirs. The wellbores may be lined with casing to protect the integrity of the wellbores and the surrounding geologic formations. Casing strings may be fixed in place by injecting cement into an annulus defined between the casing and the surrounding geologic formation. Where a smaller casing string extends through a larger casing string, cement may be injected into an annulus between the outer diameter of the smaller casing string and the inner diameter of the larger previous casing string.

Mud Line Suspension (MLS) Systems are often utilized in offshore wellbore construction, where casing is secured within a conductor pipe at the mudline or seabed. An MLS system generally includes a series of concentric hangers equipped with load supporting shoulders that transfer the weight of each casing string to the conductor and the sea bed. Each casing string may be delivered to the seabed with a running tool carried at a lower end of a removable string of casing. The running tools and the removable strings above the running tools may be removed to provide operators with flexibility of temporarily abandoning a wellbore and tying back to the well at a later dated as needed. In some situations, green cement may accumulate in an annulus surrounding the running tools, and if this green cement is permitted to cure, removal of the running tools and may be frustrated.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a running tool for installing casing in a wellbore includes a tubular body having a longitudinal axis and providing a sidewall defining an interior wall and an exterior wall opposite the interior wall. An upper connector is defined at an upper end of the tubular body for coupling with an upper portion of a casing string and a lower connector is defined at a lower end of the tubular body, the lower connector operable to releasably couple the tubular body to a casing hanger in an axially approximated position and an axially displaced position with respect to the casing hanger.

A plurality of circulation ports are defined in the sidewall and circumferentially spaced around the tubular body, each circulation port extending between the interior and exterior walls, and at least a portion of at least one circulation port extending along a trajectory obliquely arranged with respect to a radial direction defined by the tubular body to direct fluid expelled through the at least one circulation port along the exterior wall of the tubular body.

According to another embodiment consistent with the present disclosure, a wellbore system includes a conductor pipe installed through a subaquatic surface location and a lower portion of a casing string supported by a casing hanger hung from an interior of the conductor pipe. The system further includes a running tool including a tubular body having a longitudinal axis and providing a sidewall including an interior wall and an exterior wall opposite the interior wall. The tubular body is releasably coupled to the casing hanger in an axially approximated position and selectively movable to an axially displaced position with respect to the casing hanger. A plurality of circulation ports are defined in the sidewall and circumferentially spaced around the tubular body. Each circulation port is obstructed by the casing hanger when the tubular body is in the axially approximated position and exposed when the tubular body is in the axially displaced position. At least a portion of at least one circulation port extends along a trajectory obliquely arranged with respect to a radial direction defined by the tubular body to direct fluid expelled through the at least one circulation port along the exterior wall of the tubular body.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1A:
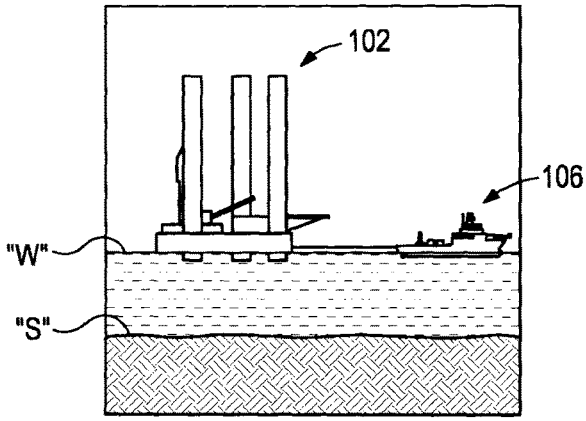
FIGS. 1A through 1F are sequential pictorial views of a drilling platform in various phases of drilling a wellbore subaquatic wellbore and temporarily suspending the wellbore in accordance with one or more aspects of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to mudline suspension systems with running tools configured to direct fluid flow therethrough, which may effectively clean an annulus surrounding the running tools. In some embodiments, circulation ports defined through the running tools extend along a particular trajectory that directs the fluid flow in a particular direction. In some other embodiments, a jet may be installed at an outer end of the circulation ports to redirect flowing through the circulation ports. The jet may have an inner diameter smaller than the circulation port to which it is attached to increase a velocity of the fluid. Turbulent flow may be generated to effectively clean the annulus surrounding the running tool.

Figure 1B:
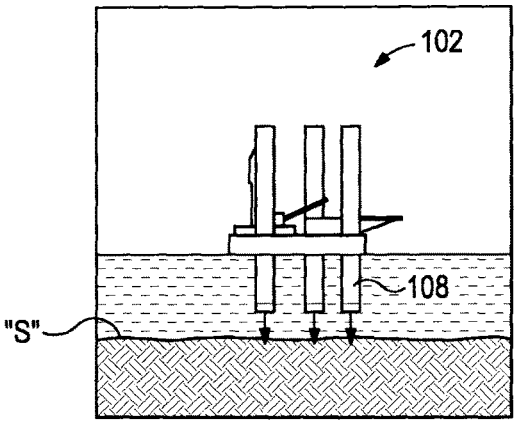
Figure 1C:
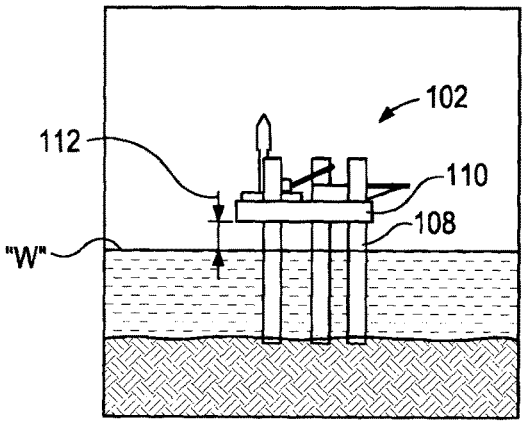
Figure 1D:
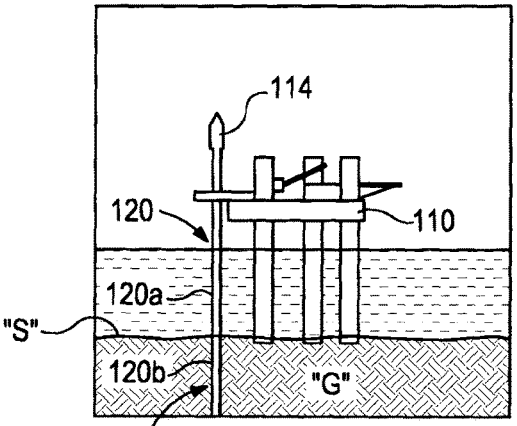
Figure 1E:
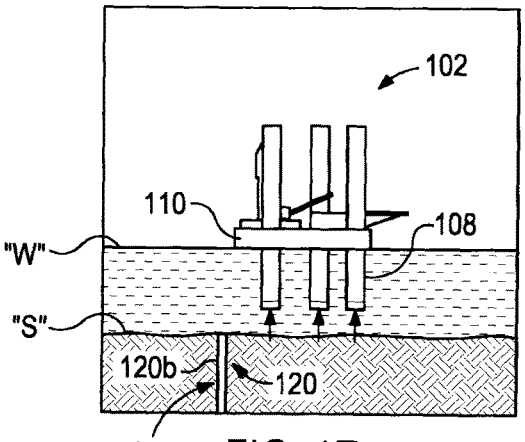

FIGS. 1A through 1F are pictorial views of a drilling platform 102 in various phases of wellbore operations including drilling of a subaquatic wellbore 104 (FIG. 1D) and temporarily suspending the wellbore 104 (FIG. 1E). In FIG. 1A, the drilling platform 102 is illustrated being towed to a drilling location by a service vessel 106, such as a ship or tugboat. The platform 102 floats on a water surface "W" that overlies a mudline, seabed lake bottom or another subaquatic surface "S." Once the platform 106 reaches the drilling location, as illustrated in FIG. 1B, the service vessel 106 may be detached from the platform 102, and legs 108 of the platform 102 may be lowered to the subaquatic surface "S" to anchor the platform in place. Next, as illustrated in FIG. 1C, a hull 110 of the platform 102 is elevated along the legs 108 off of the water surface "W" to define an air gap 112 between the hull 110 and the water surface "W."

FIG. 1D illustrates the wellbore 104 being drilled through a geologic formation underlying the subaquatic surface "S." A drilling derrick 114 may be extended outward from the hull 110 to facilitate drilling of the wellbore 104. A conductor pipe 120 may be extended from the hull 110 and into the geologic formation "G." An upper portion 120*a* of the conductor pipe 120 extends between the hull 110 and the subaquatic surface "S" and a lower portion 120*b* of the conductor pipe 120 may penetrate the geologic formation "G." Drilling and other wellbore operations may be conducted through the conductor pipe 120. As described in greater detail below, as the wellbore 104 is being drilled, a plurality of casing strings may be hung from a landing shoulder 302 (FIG. 3) defined within the conductor pipe 120. The shoulder 302 may be located at or near the subaquatic surface location "S" to facilitate temporarily suspending the wellbore 104.

Figure 1F:
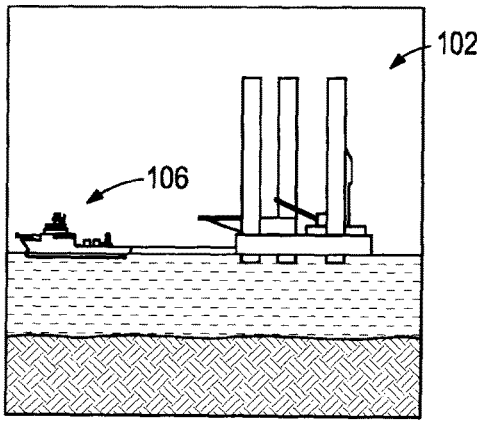

Once the drilling operations are complete, the wellbore 104 may be temporarily suspended as illustrated in FIG. 1E. Since the casing strings (see FIG. 3) have been hung from the landing shoulder 302 within the lower portion 120*b* of the conductor pipe 120, the upper portion 120*a* of the conductor pipe 120 may be removed such that the wellbore 104 is no longer coupled to the platform 102. The lower portion 120*b* may be appropriately plugged and capped with casing strings supported therein. Next the legs 108 of the platform 102 may be raised from the subaquatic surface "S" and the hull 110 may be lowered to the water surface "W." As illustrated in FIG. 1F, the platform 102 may then be towed away from the drilling location by the service vessel 106.

Figure 2:
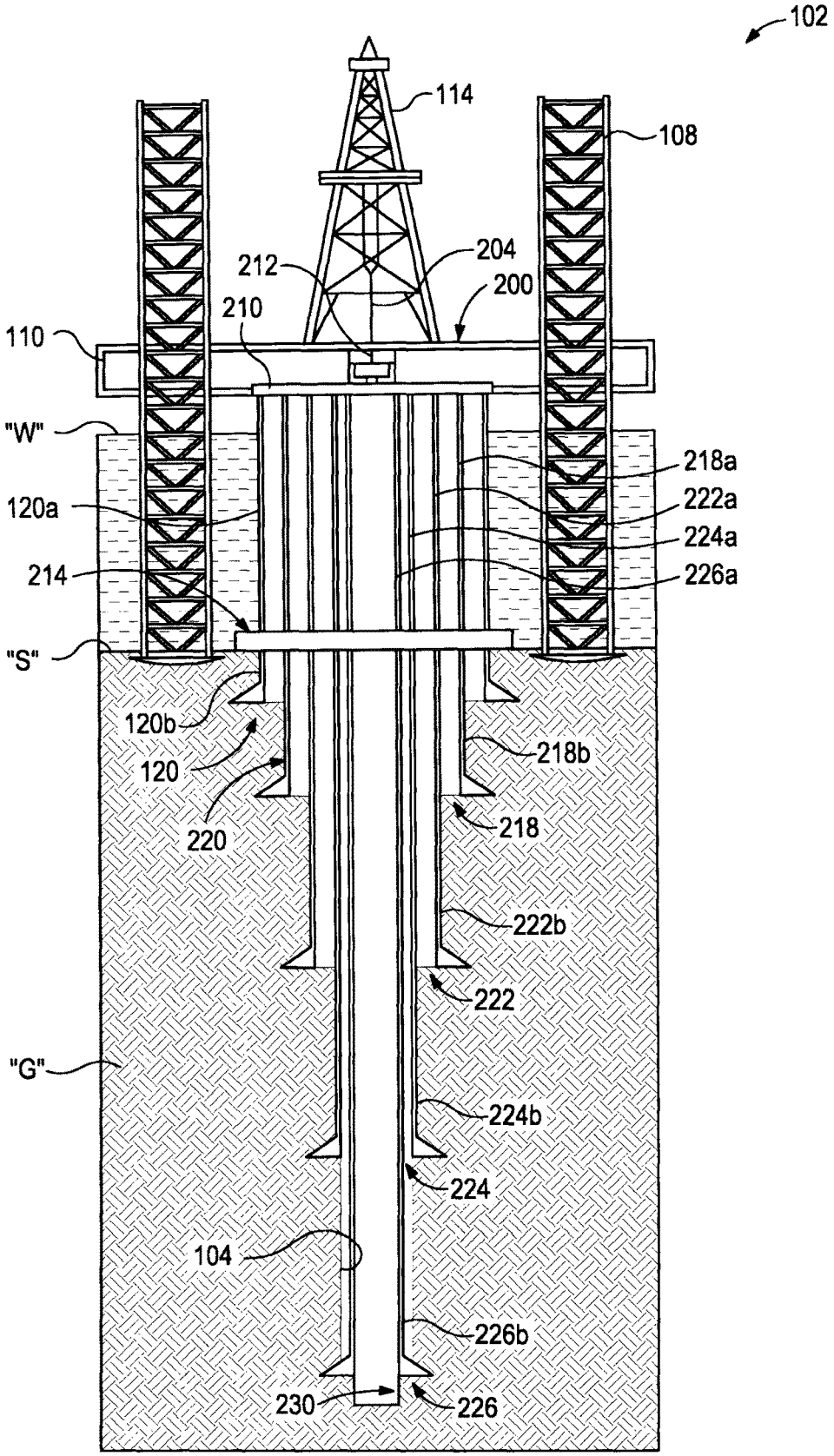
FIG. 2 is a cross-sectional schematic view of a mudline suspension system including a plurality of casing strings installed in the wellbore of FIG. 1.

Referring now to FIG. 2, a Mudline Suspension (MLS) system 200 is installed in the wellbore 104 as drilling is completed. In the illustrated example embodiment, the wellbore 104 is substantially vertical. In other embodiments, aspects of the disclosure may be practiced in a wide variety of vertical, directional, deviated, slanted and/or horizontal portions of the wellbore 104, and may extend along any trajectory through the geologic formation "G." The platform 102 is illustrated as a jack-up rig supported on the geologic formation "G" by the legs 108. In other embodiments, the platform 102 may include a ship or other platform floating on the water surface "W" without departing from the scope of the disclosure. The drilling derrick 114 facilitates handling of a drill pipe 204, which may be extended into the wellbore 104 through the conductor pipe 120. The drill pipe 204 may be rotated to drill the wellbore 104 using techniques recognized in the art. The platform 102 also supports a surface wellhead 210 and a BOP stack 212 to contain drilling fluids and protect drilling personnel while the wellbore 104 is being drilled.

The MLS system 200 generally supports the weight of casing strings within the wellbore 104 at or near the subaquatic surface "S" and provides the ability to disconnect and reconnect from the wellbore 104 as needed. The MLS system 200 includes the conductor pipe 120, which in some embodiments, may have a 30-inch nominal diameter and may be set 200 feet into the geologic formation "G" below the subaquatic surface "S." The conductor pipe 120 may be installed through the subaquatic surface "S" with a pile driver, for example, or by drilling or other alternative methods. The conductor pipe 120 generally defines a mudline casing hanger profile 214 at or near the subaquatic surface "S." For example, in some embodiments, the mudline casing hanger profile 214 may be defined within the conductor pipe 120 about 15 feet below (or above) the subaquatic surface location "S."

A surface casing string 218 may be extended concentrically within the conductor pipe 120 from the surface wellhead 210 and into the wellbore 104. An upper portion 218*a* of the surface casing string 218 extends generally between the hull 110 and the casing hanger profile 214. A lower portion 218*b* of the surface casing string 218 may be supported on the landing shoulder 302 (FIG. 3) defined within the conductor pipe 122 at the mudline casing hanger profile 214. The surface casing string 218 may have a nominal diameter of 20 inches and may extend to a depth of about 650 feet in some embodiments. The length and depth of the casing strings described herein may vary depending on the casing size and strength, and the external forces (e.g., hydrostatic gradient (pore pressure) and internal pressures (drilling fluid weight)) experienced by the casing strings. Any specific values given herein for the length or depth of a casing string are exemplary only. The lower portion 218*b* of the surface casing string 218 may be cemented into place, e.g., an annulus 220 defined between the lower portion 218*b* of the surface casing string 218 and the lower portion 120*b* of the conductor pipe 120 and geologic formation "G" may filled with cement. Other casing strings described herein may similarly be cemented in place within the wellbore 104.

Within the surface casing string 218, a first intermediate casing string 222 may be extended from the surface wellhead 210 and into the wellbore 104. An upper portion 222*a* of the first intermediate casing string 222 extends between the hull 110 and the mudline casing hanger profile 214. A lower portion 222*b* of the first intermediate casing string 222 may be hung at the mudline casing hanger profile 214 and cemented in place. Specifically, the lower portion 222*b* of the first intermediate casing string 222 may be hung from the landing shoulder 302 (FIG. 3) on an interior of the surface casing string 218. The first intermediate casing string 222 may have a nominal diameter of 13⅜ inches and may extend to a depth of about 2,500 feet in some example embodiments.

A second intermediate casing string 224 may be extended concentrically through the first intermediate casing string 222 from the surface wellhead 210 and into the wellbore 104. An upper portion 224*a* of the second intermediate casing string 224 extends between the hull 100 and the mudline casing hanger profile 214. A lower portion 224*b* of the second intermediate casing string 224 may be hung from the mudline casing hanger profile 214 and cemented in place. The second intermediate casing string 224 may have a nominal diameter of 9⅝ inches and ma extend to a depth of about 4,500 feet in some example embodiments.

A production casing string 226 may be extended concentrically through the second intermediate casing string 224 from the surface wellhead 210 and into the wellbore 104. An upper portion 226*a* of the production casing string 226 extends between the hull 110 and the mudline casing hanger profile 214. A lower portion 224*b* of the production casing string 226 may be hung from the mudline casing hanger profile 214 and cemented in place. The production casing string 226 may have a nominal diameter of 7 inches and may extend to a depth of about 7,000 feet in some example embodiments. An open-hole portion 230 of the wellbore 104 may be defined below the production casing string 226.

Generally, the casing strings are installed sequentially after the wellbore section has been drilled to a sufficient depth. First, the surface casing string 218 installed followed by the first intermediate casing string 222, the second intermediate casing string 224 and finally the production casing string 226. Those skilled in the art will recognize that more or fewer casing strings may be installed in the wellbore, and one or more liners may also be installed without departing from the scope of the disclosure. Once drilling is complete, the upper portions of the casing strings may be removed in an opposite order to temporarily suspend the wellbore 104. First the upper portion 226*a* of the production casing string 226 may be removed, followed by the upper portion 224*a* of the second intermediate casing string 224, and the upper portion 222*a* of the first intermediate casing string 222, and finally the upper portion 218*a* of the surface casing string 218 may be removed above the mudline casing hanger profile 214. The conductor pipe 120 may be severed above the casing hanger profile 214, and the upper portion 120*a* may be removed. The wellbore 104 may be appropriately plugged to permit the wellbore 104 to be temporarily suspended with the casing strings 218, 222, 224 and 226 supported in the lower portion 120*b* of the conductor pipe.

Figure 3:
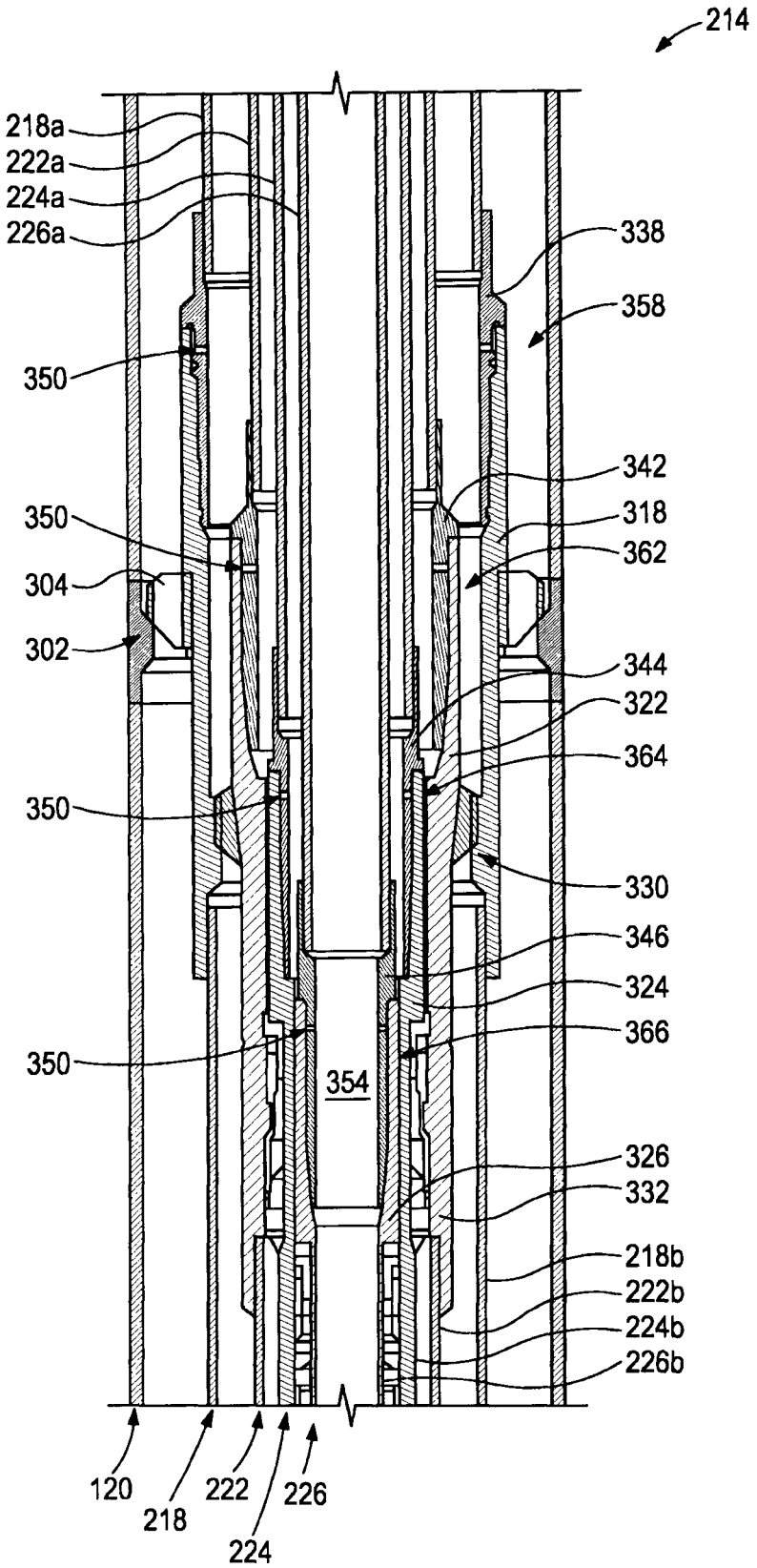
FIG. 3 is a partial, cross-sectional view of a mudline casing hanger profile of the of the MLS system of FIG. 2 illustrating the plurality casing strings hung from the mudline casing hanger and a plurality of corresponding running tools coupled to upper ends of the casing strings.

Referring now to FIG. 3, a cross-sectional side view of the mudline casing hanger profile 214 is illustrated. A landing shoulder 302 is defined on an interior of the conductor pipe 120. The landing shoulder 302 may be integrally formed on the conductor pipe 120, or in some embodiments, the landing shoulder 302 may be formed on a separate mandrel interconnected between sections of the conductor pipe 120 by threads or other connectors. A landing ring 304 rests on the landing shoulder 302 and supports the casing strings 218, 222, 224 and 226 thereon. Each of the casing strings 218, 222, 224 and 226 include a casing hanger and a running tool coupled therein, which facilitate supporting the casing string on the landing shoulder 302.

The lower portions 218*b*, 222*b*, 224*b* and 226*b* of the casing strings 218, 222, 224 and 226 include respective casing hangers 318, 322, 324 and 326 at corresponding upper ends thereof. More specifically, a surface casing hanger 318 rests on the landing ring 304 and supports the lower portion 218*b* of the surface casing string 218 thereon. A first intermediate casing hanger 322 rests on an interior shoulder 330 of the surface casing hanger 318 and supports the lower portion 222*b* of the first intermediate casing string 218 thereon. A second intermediate casing hanger 324 rests on an interior shoulder 332 of the first intermediate casing hanger 322 and supports the lower portion 224*b* of the second intermediate casing string 224 thereon. A production casing hanger 326 rests on an interior shoulder (not shown) of the second intermediate casing hanger 322 and supports the lower portion 226*b* of the production casing string 226 thereon.

The upper portions 218*a*, 222*a*, 224*a* and 226*a* of the casing strings 218, 222, 224, 226 include respective running tools 338, 342, 344, 346 operatively coupled to corresponding lower ends thereof. Each of the running tools 338, 342, 344, 346 is threaded to a respective one of the casing hangers 318, 322, 324, 326. Each of the running tools 338, 342, 344, 346 includes a plurality of circulation ports 350 defined through a circumferential wall thereof and circumferentially (equidistantly or non-equidistantly) spaced from one another. As illustrated in FIG. 3, when the running tools 338, 342, 344, 346 are operatively coupled to the corresponding casing hanger 318, 322, 324, 326, radially outer ends of the circulation ports 350 are positioned adjacent inner walls of one of the casing hangers 218, 222, 224, 226, and otherwise substantially occluded by the radially outward casing hanger 218, 222, 224, 226, such that flow through the circulation ports 350 is obstructed. As described in greater detail below, each of the running tools 338, 342, 344, 346 may be rotated to disengage threads on the respective casing hangers 218, 222, 224, 226 and thereby axially separate the running tool 338, 342, 344, 346 from the corresponding casing hanger 218, 222, 224, 226. The circulation ports 350 may then become exposed and provide fluid communication between an interior flow path 354 through the casing strings 218, 222, 224, 226 and a corresponding annulus 358, 362, 364, 366 defined between the running tool 338, 342, 344, 346 and the radially outward casing hanger 218, 222, 224, 226.

Figure 4:
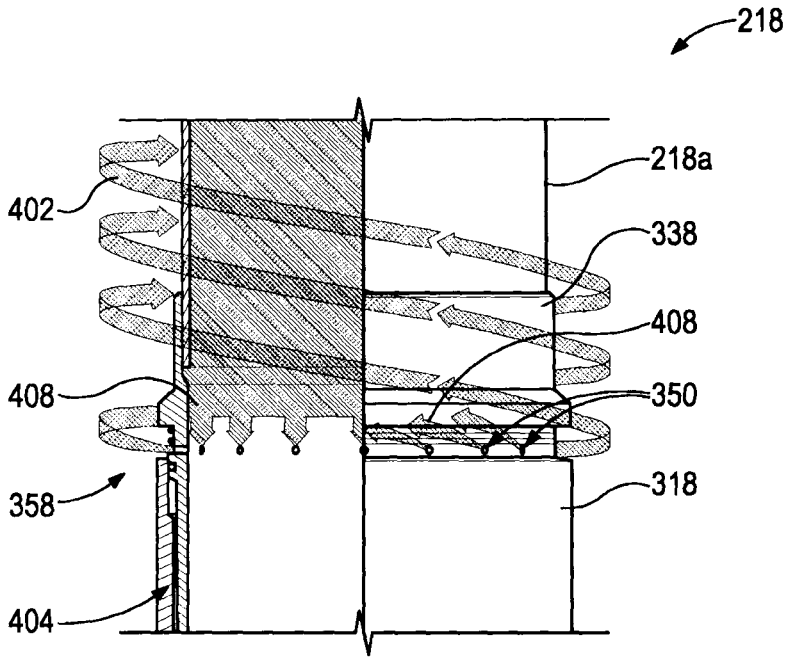
FIG. 4 is a partial, cross-sectional view of one of the running tools of FIG. 3 rotated with respect to a casing hanger of the corresponding casing string to expose a plurality of circulation ports defined through the running tool.

Referring now to FIG. 4, the first surface running tool 338 is illustrated in an axially displaced position with respect to the surface casing hanger 318 such that the circulation ports 350 are exposed. Once the surface casing string 218 has been cemented in place, the upper portion 218*a* of the surface casing string 218 may be rotated two or more revolutions (e.g., about 4 or 5 times) in a clockwise direction with respect to the surface casing hanger 318 as indicated by arrows 402. The rotation causes helical threads 404 defined on the surface casing hanger 318 and helical threads 508 (FIG. 5) defined on the surface running tool 338 to at least partially disengage (unthread) and move the surface running tool 338 axially away from the surface casing hanger 318, which eventually exposes the ports 350. Once the ports 350 are exposed, t cleansing fluid 408 may then be circulated through the interior flow path 354 (FIG. 3) and out through the circulation ports 350 to remove any debris or cement that may have accumulated in the circulation ports 350 or the annulus 358 around the running tool 338 as the surface casing string 218 was cemented in place.

Once the cement and debris has been removed, the upper portion 218*a* of the surface casing string 218 may be rotated in a counter-clockwise direction to re-engage the threads 404 and move the surface running tool 338 axially toward the surface casing hanger 318 to close the circulation ports 350. Each of the other running tools 342, 344 and 346 (FIG. 3) may be operated in a similar manner once the corresponding casing strings 222, 224, and 226 are cemented in place.

Figure 5:
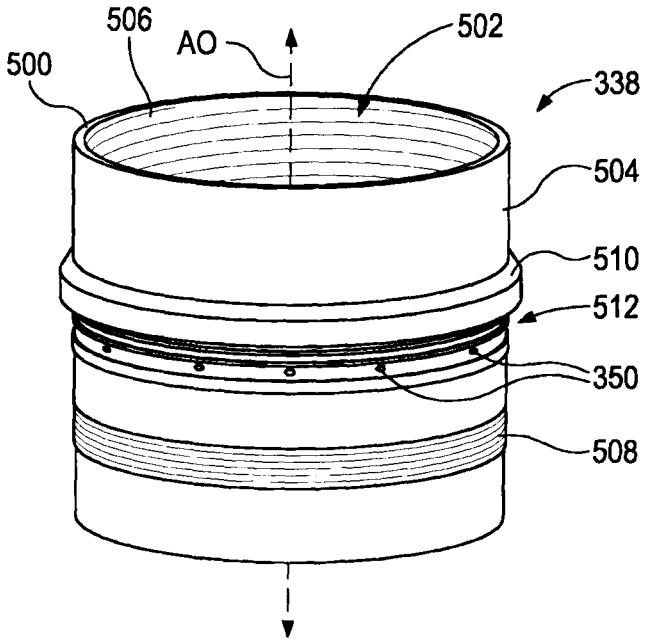
FIG. 5 is a perspective view of the running tool FIG. 4 illustrating the plurality of circulation ports circumferentially spaced around the running tool.

Referring now to FIG. 5, the surface running tool 338 is illustrated. Each of the other running tools 342, 344 and 346 (FIG. 3) described herein may include features similar to the features of the running tool 338 described herein. The running tool 338 includes a tubular body 500 defining an interior wall 502, an exterior wall 504 and a longitudinal axis A0 extending therethrough. An upper connector 506 is defined on the interior wall 502 for coupling the surface running tool casing pipes forming the upper portion 218*a* of the surface casing string 218 (FIG. 4). In the illustrated embodiment, the upper connector 506 may include a helical thread at an upper end of the tubular body 500.

A lower connector 508 is defined on the exterior wall 504 at a lower axial end of the tubular body 500. The lower connector 508 may comprise a helical thread for engaging the threads 404 of the surface casing hanger 318 (FIG. 4). A circumferential flange 510 may be defined axially above the circulation ports 350 on the exterior wall 504 (e.g., the outer circumferential surface). The circumferential flange 510 may serve as a stop to limit the travel of the surface running tool 338 with respect to the surface casing hanger 318. Radially outer ends of the circulation ports 350 may be defined in a circumferential recess 512. According to aspects of the present disclosure, the circulation ports 350 may be oriented to direct the flow of the cleaning fluid 408 (FIG. 4) in a particular direction to effectively clean the circulation ports 350 and the surrounding annulus 358 (FIG. 4).

Figure 6A:
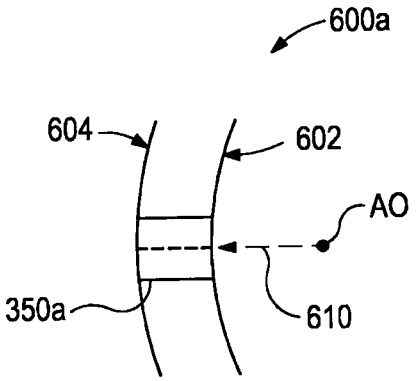
FIGS. 6A through 6F are various cross-sectional views of a running tool including a circulation port therethrough, illustrating various orientations and configurations of the circulation port for directing fluid flow in accordance with one or more aspects of the present disclosure.

FIGS. 6A through 6F are cross-sectional views of various running tools (generally 600) that include one or more circulation ports (generally 350) that extend through a sidewall thereof. FIG. 6A illustrates a running tool 600*a* defining an interior wall 602 and an exterior wall 604 that cooperatively define a sidewall of the running tool 600*a*, and a central longitudinal axis A0 extends along a centerline through the running tool 600*a*. A circulation port 350*a* extends between the interior and exterior walls 602, 604 in a purely radial direction as indicated by arrow 610.

Figure 6B:
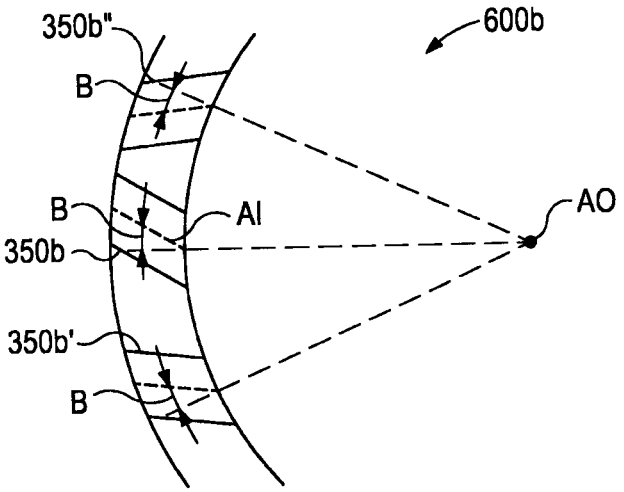

FIG. 6B illustrates an alternate running tool 600*b* including a circulation port 350*b* extending along trajectory defined by an oblique axis A1 with respect to the radial direction. The axis A1 may be oriented at an angle B with respect to the radial direction such that the trajectory includes a circumferential component to direct cleaning fluid in a clockwise or counter clockwise direction around the running tool 600*b*. In some example embodiments, the oblique angle B may be in a range from about 10° to about 45° (or a range from about −10° to about −45°). In other example embodiments, the oblique angle B may be in a range from about 45° to about 80° (or a range from about −45° to about)−80°. Generally, steeper angles may promote greater circumferential flow around the running tool 600*b*. Adjacent circulation ports, e.g., circulation port 350*b*' may be oriented along a similar oblique angle B such that the circumferential flow around the running tool 600*b* is generally unidirectional. Unidirectional circumferential flow around the running tool 600*b* may be effective to remove accumulated debris or cement around the running tool 600*b* in some embodiments.

In other embodiments, flow patterns other than unidirectional circumferential flow may be established with circulation ports oriented in different directions. For example, in some example embodiments, adjacent circulation ports, e.g., circulation ports 350*b* and 350*b*", may be oriented along an opposite oblique angles, B and −B. Trajectories defined by the circulation ports 350*b* and 350*b*" may intersect on an exterior of the running tool 600*b*, e.g., in the annulus surrounding the running tool 600*b*, to encourage turbulent flow.

Figure 6C:
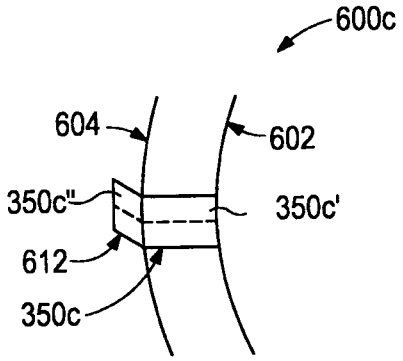

FIG. 6C illustrates a running tool 600*c* including a circulation port 350*c* extending through the sidewall thereof. The circulation port 350*c* includes a first portion 350*c*' extending between the interior and exterior walls 602, 604 in a first direction and a second portion 350*c*" extending in a second direction. The second portion 350*c*" extends through or comprises a nozzle or jet 612 affixed to the exterior wall 604. The first portion 350*c*' may direct cleaning fluid 408 (FIG. 4) along a radial direction and the jet 612 redirects the cleaning fluid 408 in an oblique direction with respect to the radial direction. In some embodiments a casing hanger (not shown) arranged to receive the running tool 600*c* may include an interior recess to accommodate nozzles or jets 612 protruding radially beyond the outer wall 604. In other embodiments, the nozzles or jets 612 may be recessed within the respective first portions 350*d*, such that the nozzles or jets 612 do not protrude radially beyond the exterior wall 604 or otherwise interfere with threading the running tool 600*c* into a casing hanger (not shown). In some embodiments, the nozzles or jets 612 may be spring loaded within the respective first portions 350*d* such that the nozzles or jets 612 spring radially outward upon being exposed by unthreading the running tool 600*c* from a casing hanger (not shown).

Figure 6D:
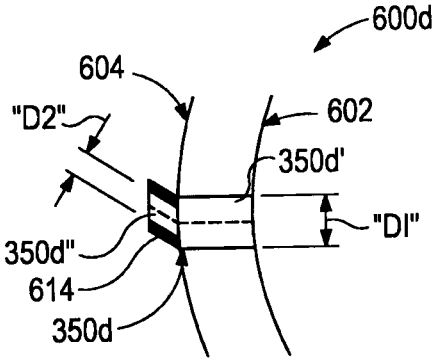

FIG. 6D illustrates a running tool 600*d* including a circulation port 350*d* extending through the sidewall thereof. The circulation port 350*d* may include a first portion 350*d*' having a first diameter "D1" or cross sectional area extending between the interior and exterior walls 602, 604 and second portion 350*c*" having a second diameter "D2" or cross sectional area extending through a jet 614. In some embodiments, the second diameter "D2" may be smaller than the first diameter "D1" such that cleaning fluid 408 (FIG. 4) may be accelerated when passing through the circulation port 350*c*.

In FIGS. 6C and 6D, the jets 612, 614 may be installed to the exterior wall to redirect the cleaning fluid 408. In some embodiments, the jets 612, 614 are fixed with respect to the exterior wall 604, for example by welding, and in other embodiments, the jets 612, 614 may be threaded into the first portions 350*c*', 350*d*' of the circulation ports 350*c*, 350*d*. The jets 612, 614 circumferentially spaced around a running tool 600*c*, 600*d* may each be oriented at similar oblique angles to encourage unidirectional flow around the running tool 600*c*, 600*d* in a clockwise or counterclockwise direction. In some other embodiments, the jets 612, 614 may be rotatably mounted to the exterior walls 604 such that the jets may rotate about the radial direction. Rotatable jets 612, 614 may not encourage unidirectional flow around the running tool 600*c*, 600*d*, but could encourage turbulent flow or serve other functions.

Figure 6E:
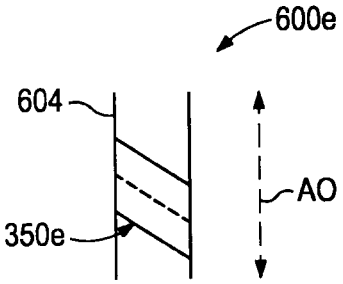
Figure 6F:
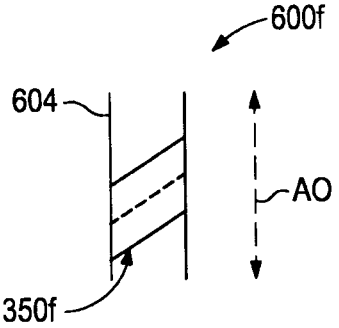

FIGS. 6E and 6F illustrate running tools 600*e*, 600*f* including respective circulation ports 350*e*, 350*f* extending along trajectories with an axial component. Circulation port

350*e*, for example, extends in an axially upward direction with respect to the longitudinal axis A0 and circulation port 350*f* extends in an axially downward direction with respect to the longitudinal axis A0. Fluid expelled through the circulation ports 350*e*, 350*f* may be directed axially along the exterior wall 604 either in the uphole direction (port 350*e*) or the downhole direction (port 350*f*).

The terminology used herein is for the purpose of describing particular embodiments only and is not intended to be limiting of the invention. As used herein, for example, the singular forms "a," "an." and "the" are intended to include the plural forms as well, unless the context clearly indicates otherwise. It will be further understood that the terms "contains", "containing", "includes", "including." "comprises", and/or "comprising." and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A running tool for installing casing in a wellbore, the running tool comprising:

a tubular body having a longitudinal axis and providing a sidewall defining an interior wall and an exterior wall opposite the interior wall;

an upper connector defined at an upper end of the tubular body for coupling with an upper portion of a casing string;

a lower connector defined at a lower end of the tubular body, the lower connector operable to releasably couple the tubular body to a casing hanger in an axially approximated position and an axially displaced position with respect to the casing hanger; and a plurality of circulation ports defined in the sidewall and circumferentially spaced around the tubular body, each circulation port extending between the interior and exterior walls, and at least a portion of at least one circulation port extending along a trajectory obliquely arranged with respect to a radial direction defined by the tubular body to direct fluid expelled through the at least one circulation port along the exterior wall of the tubular body, wherein the at least two circulation ports are oriented along opposite oblique angles with respect to the radial direction.

2. The running tool of claim 1, further comprising a jet affixed to the outer wall, wherein the at least one circulation port extends through the jet.

3. The running tool of claim 2, wherein a first portion of the at least one circulation port extends between the interior wall and the exterior wall and has a first diameter, and wherein a second portion of the at least one circulation port extends through the jet and has a second diameter smaller than the first diameter.

4. The running tool of claim 1, wherein the trajectory of the at least one circulation port includes an axial component such that fluid expelled through the at least one circulation port is directed in an axial direction along the exterior wall of the tubular body.

5. The running tool of claim 1, wherein the trajectory of the at least one circulation port extends at an oblique angle in a range from about 45° to about 80° with respect to the radial direction.

6. The running tool of claim 1, wherein the lower connector includes a helical thread defined on the exterior wall.

7. The running tool of claim 6, further comprising a circumferential flange extending from the exterior wall of the tubular body to limit the travel of the running tool as the helical thread is engaged with the casing hanger.

8. The running tool of claim 1, wherein the at least two circulation ports include two adjacent circulation ports.

9. The running tool of claim 1, wherein the trajectories of the at least two circulation ports include a circumferential component such that fluid expelled through a first one of the least two circulation ports is directed in a clockwise direction and fluid expelled through a second one of the least two circulation ports is directed in a counter-clockwise direction.

10. The running tool of claim 1, wherein trajectories defined by the at least two circulation ports intersect on an exterior of the running tool.

11. A wellbore system, comprising:

a conductor pipe installed through a subaquatic surface location;

a lower portion of a casing string supported by a casing hanger hung from an interior of the conductor pipe;

a running tool including a tubular body having a longitudinal axis and providing a sidewall including an interior wall and an exterior wall opposite the interior wall, the tubular body being releasably coupled to the casing hanger in an axially approximated position and selectively movable to an axially displaced position with respect to the casing hanger;

a plurality of circulation ports defined in the sidewall and circumferentially spaced around the tubular body, each circulation port being obstructed by the casing hanger when the tubular body is in the axially approximated position and exposed when the tubular body is in the axially displaced position, at least a portion of at least one circulation port extending along a trajectory obliquely arranged with respect to a radial direction defined by the tubular body to direct fluid expelled through the at least one circulation port along the exterior wall of the tubular body; and a jet affixed to the outer wall of the tubular body, wherein the at least one circulation port extends through the jet and wherein a first portion of the at least one circulation port extends between the interior and exterior walls along a first trajectory, and wherein a second portion of the at least one circulation port extends through the jet along a second trajectory obliquely arranged with respect to the first trajectory such that the jet redirects fluid flowing through the at least one circulation port.

12. The wellbore system of claim 11, wherein the first portion of the at least one circulation port has a first diameter, and the second portion of the at least one circulation port has a second diameter smaller than the first diameter.

13. The wellbore system of claim 11, wherein the trajectory of the at least one circulation port includes a circumferential component such that fluid expelled through the at least one circulation port is directed in a clockwise or counterclockwise direction around the exterior wall of the tubular body.

14. The wellbore system of claim 11, wherein the tubular body is coupled to the casing hanger by helical threads disengagable from one another to move the tubular body from the axially approximated position to the axially displaced position.

15. The wellbores system of claim 11, wherein a cross-sectional area of the at least one circulation port varies along the trajectory of the at least one circulation port.

16. The wellbore system of claim 11, wherein the running tool is coupled in an upper portion of the casing string and wherein the upper portion of the casing string extends to a surface wellhead.

17. The wellbore system of claim 11, wherein trajectories defined by the adjacent circulation ports of the plurality of circulation ports intersect on an exterior of the running tool.

18. The wellbore system of claim 11, wherein the jet is rotatably mounted to the outer wall of the tubular body.

* * * * *